US011325162B2

(12) United States Patent
Wang et al.

(10) Patent No.: US 11,325,162 B2
(45) Date of Patent: May 10, 2022

(54) BOLT SCREENING MACHINE

(71) Applicant: SOOCHOW UNIVERSITY, Jiangsu (CN)

(72) Inventors: Gang Wang, Suzhou (CN); Zhihua Feng, Suzhou (CN); Junfang Ni, Suzhou (CN); Xiangjun Lan, Suzhou (CN)

(73) Assignee: SOOCHOW UNIVERSITY, Jiangsu (CN)

( * ) Notice: Subject to any disclaimer, the term of this patent is extended or adjusted under 35 U.S.C. 154(b) by 0 days.

(21) Appl. No.: 16/954,584

(22) PCT Filed: Oct. 10, 2018

(86) PCT No.: PCT/CN2018/109614
§ 371 (c)(1),
(2) Date: Jun. 17, 2020

(87) PCT Pub. No.: WO2020/010733
PCT Pub. Date: Jan. 16, 2020

(65) Prior Publication Data

US 2021/0362193 A1 Nov. 25, 2021

(30) Foreign Application Priority Data

Jul. 13, 2018 (CN) ..... 201810770505.4

(51) Int. Cl.
*B07B 13/04* (2006.01)
*B07B 13/11* (2006.01)
(Continued)

(52) U.S. Cl.
CPC ..... *B07B 13/16* (2013.01); *B07B 13/05* (2013.01)

(58) Field of Classification Search
CPC ..... B07B 13/16; B07B 13/05; B07B 13/14; B65G 47/14; B65G 47/1421; B65G 47/24; B65G 2812/0392; B65G 2207/24
(Continued)

(56) References Cited

U.S. PATENT DOCUMENTS 3,011,625 A * 12/1961 Bailey ..... B65G 27/00 198/757
3,178,008 A * 4/1965 Solet ..... B65G 1/06 198/546

FOREIGN PATENT DOCUMENTS

CN 201580781 U 9/2010
CN 203612526 U 5/2014
(Continued)

OTHER PUBLICATIONS

"Bolt Automatic Supply Device" (English Translation), worldwide.espacenet.com, Feb. 18, 2004 (Year: 2004).*
(Continued)

*Primary Examiner* — Michael McCullough
*Assistant Examiner* — Molly K Devine
(74) *Attorney, Agent, or Firm* — Schmeiser, Olsen & Watts, LLP

(57) ABSTRACT

Provided is a bolt screening machine, including an external frame, a feeding mechanism, and a screening mechanism, wherein the feeding mechanism and the screening mechanism are combined with and mounted on the external frame, the unscreened bolts are fed into the screening mechanism through the feeding mechanism, and the screening mechanism screens and arranges the bolts.

9 Claims, 4 Drawing Sheets

(51) Int. Cl.
*B07B 13/14* (2006.01)
*B07B 13/16* (2006.01)
*B07B 13/05* (2006.01)

(58) Field of Classification Search
USPC ..... 209/240
See application file for complete search history.

(56) References Cited

FOREIGN PATENT DOCUMENTS

| | | | |
|---|---|---|---|
| CN | 203695435 | U | 7/2014 |
| CN | 105151681 | A | 12/2015 |
| CN | 205042745 | U | 2/2016 |
| CN | 106111544 | A | 11/2016 |
| CN | 106115448 | A | 11/2016 |
| CN | 205995803 | U | 3/2017 |
| CN | 206009249 | U | 3/2017 |
| CN | 206316031 | U | 7/2017 |
| CN | 107215638 | A | 9/2017 |
| CN | 206665542 | U | 11/2017 |
| JP | 2001240237 | A | 9/2001 |
| KR | 200342180 | Y1 * | 2/2004 |

OTHER PUBLICATIONS

International Search Report dated Dec. 12, 2018 for PCT/CN2018/109614.

* cited by examiner

BOLT SCREENING MACHINE

CROSS-REFERENCE TO RELATED APPLICATIONS

This application claims priority to PCT Application No. PCT/CN2018/109614, having a filing date of Oct. 10, 2018, which is based on Chinese Application No. 201810770505.4, having a filing date of Jul. 13, 2018, the entire contents both of which are hereby incorporated by reference.

FIELD OF TECHNOLOGY

The following relates to the field of mechanical assembly manufacturing techniques, and more specifically relates to a bolt screening machine.

BACKGROUND

In industrial manufacturing, bolts are widely used, and the application range thereof comprises electronic products, mechanical products, digital products, power equipment and the like. For different application areas, the types and sizes of bolts to be used are also different. Large bolts and nuts are used in the fields of engineering, construction, bridges, etc., general bolts are used in the fields of televisions, electrical appliances products, furniture, etc., and micro bolts are used in some digital products. Even in the same field, bolts of different sizes may be used. Therefore, in the bolt processing industry, bolts need to be screened, and the traditional screening mainly relies on manual visual inspection and manual screening and picking, however, this method has low precision, slow speed, low screening accuracy and efficiency, and prone to screening errors. In order to solve the problems of manual screening, in this industry, machines specifically for bolt screening have been developed, and the existing bolt screening machines usually use a combined structure of a vibration device and a screening device to achieve screening, and the existing bolt screening machines can achieve screening of different sizes of bolts, but the structures thereof are usually complicated and the efficiency is not high. For example, Patent application No. CN201320883369.2, discloses an auto-feeder for directed screwdriver head arraying device, which comprises a vibrating disk, a feeding rail which spirally rises is arranged inside the vibrating disk, a removing slant knife is arranged inside the vibrating disk, and the tip of the removing slant knife extends to the feeding rail and forms a selection channel together with the feeding rail. Finally, the removing slant knife screens the screws to achieve the separation effect. In the above patent, the screening rail and screening port are single, and it is not possible to screen multiple types of bolts, is not easy to control the screws on the rail during the conveying process, and is inconvenient to select and inefficient; the bolts are conveyed from bottom to top to overcome gravity acting, which consumes large energy; the vibrating disk has a certain frequency requirement for the vibration source, and long-term use will cause the phenomenon of component aging, which will affect the vibration frequency. In summary, the existing bolt screening machine cannot meet the requirements for quick and effective screening, and the energy consumption is large.

SUMMARY

An aspect relates to a bolt screening machine, comprising an external frame, a feeding mechanism and a screening mechanism, the feeding mechanism and the screening mechanism being combined with and mounted with the external frame, the unscreened bolts being fed into the screening mechanism through the feeding mechanism, the screening mechanism screening and arranging the bolts, and during the screening process, the bolts move from top to bottom, and by adjusting the screening mechanism, both the screening and arrangement of multiple types of bolts can be realized at the same time.

To achieve the above purpose, the present disclosure provides a bolt screening machine, comprising an external frame, a feeding mechanism and a screening mechanism, the feeding mechanism is combined with and mounted on a top of the external frame, the screening mechanism is combined and mounted inside the external frame, the screening mechanism is downward spiral slideway structure and comprises at least one section of spiral slideway, the spiral slideway has a sliding chute and a discharge part provided for bolts to be screened, and after the bolts enter the screening mechanism through the feeding mechanism, the bolts spirally slide down in the screening mechanism, are screened through the sliding chute and then discharged through the discharge part.

Alternatively, the feeding mechanism comprises a feeding support, a feeding barrel and a feeding slideway, a top of the feeding support has a feeding support plate, a bottom end of the feeding barrel vertically penetrates the feeding support plate to connect with the feeding support plate, the feeding slideway is arranged at a bottom of the feeding support plate, and one end of the feeding slideway is rotatably connected with the feeding support.

Alternatively, the feeding mechanism comprises a feeding electromagnet assembly, the feeding electromagnet assembly comprises a first feeding electromagnet and a second feeding electromagnet, the first feeding electromagnet is disposed at the bottom of the feeding support plate, the second feeding electromagnet is arranged on the feeding slideway, and the first feeding electromagnet is facing to the second feeding electromagnet.

Alternatively, the screening mechanism comprises a base, a lower bottom plate, an upper top plate, a plurality of slideway support frames, a straight slideway, and a spiral slideway assembly, each slideway support frame is connected between the lower bottom plate and the upper top plate, the base is fixedly connected to a bottom of the external frame, top of the base is a slope, the lower bottom plate is rotatably connected to top of the slope on the top of the base, the upper top plate and the lower bottom plate are arranged in parallel in alignment and the upper top plate is disposed close to the top of the external frame, the straight slideway and the spiral slideway assembly are fixedly connected to at least one of the slideway support frames respectively, and the straight slideway is arranged at a position near the upper top plate and the straight slideway extends beyond a horizontal coverage of the upper top plate, and a portion of the straight slideway extending beyond the horizontal coverage of the upper top plate is vertically aligned with the feeding slideway.

Alternatively, the spiral slideway assembly comprises at least one section of spiral slideway, the spiral slideway comprises an upper slideway, the discharge part and a lower slideway, the upper slideway, the discharge part and the lower slideway are spirally arranged and connected from top to bottom, and a bottom of the upper slideway has an upper sliding chute, and the upper sliding chute extends to the discharge part along a spiral direction of the upper slideway.

Alternatively, the discharge part has a discharge chute, one end of the discharge chute is docked with the upper sliding chute, and the bolts falling into the upper sliding chute will slide into the discharge chute along the upper sliding chute, the other end of the discharge chute extends to a side wall of the discharge part and penetrates the side wall of the discharge part, the discharge part has a discharge opening at a position where the discharge chute extends out of the side wall, and the discharge opening extends linearly.

Alternatively, the upper top plate comprises a vibrating electromagnet assembly, and the vibrating electromagnet assembly is provided in combination with the upper top plate and a top end of the external frame.

Alternatively, the top of the base has a slope, the top of the slope has a hinge group, and the lower bottom plate is rotatably connected to the base through the hinge group.

Alternatively, a bottom end of the slope is provided with a leaf spring group, and the lower bottom plate is connected to the base through the leaf spring group.

Alternatively, a top of the slope is evenly provided with a plurality of springs.

The bolt screening machine disclosed by the present disclosure has the following advantages over the conventional art: the bolt screening machine can screen and arrange multiple types of bolts at the same time, with high efficiency; the spiral structure occupies a small space, which is helpful to reduce the volume of the machine; the bolt discharge process is from top to bottom, and utilizes gravity acting, which can effectively reduce energy consumption; the screening process has low requirements on vibration frequency and vibration stability, which can effectively reduce the requirements for vibration control, reduce costs and simplify the process at the same time, and which is conducive to large-scale and low-cost automation of bolt screening.

BRIEF DESCRIPTION

Some of the embodiments will be described in detail, with references to the following Figures, wherein like designations denote like members, wherein.

DETAILED DESCRIPTION

Figure 1:
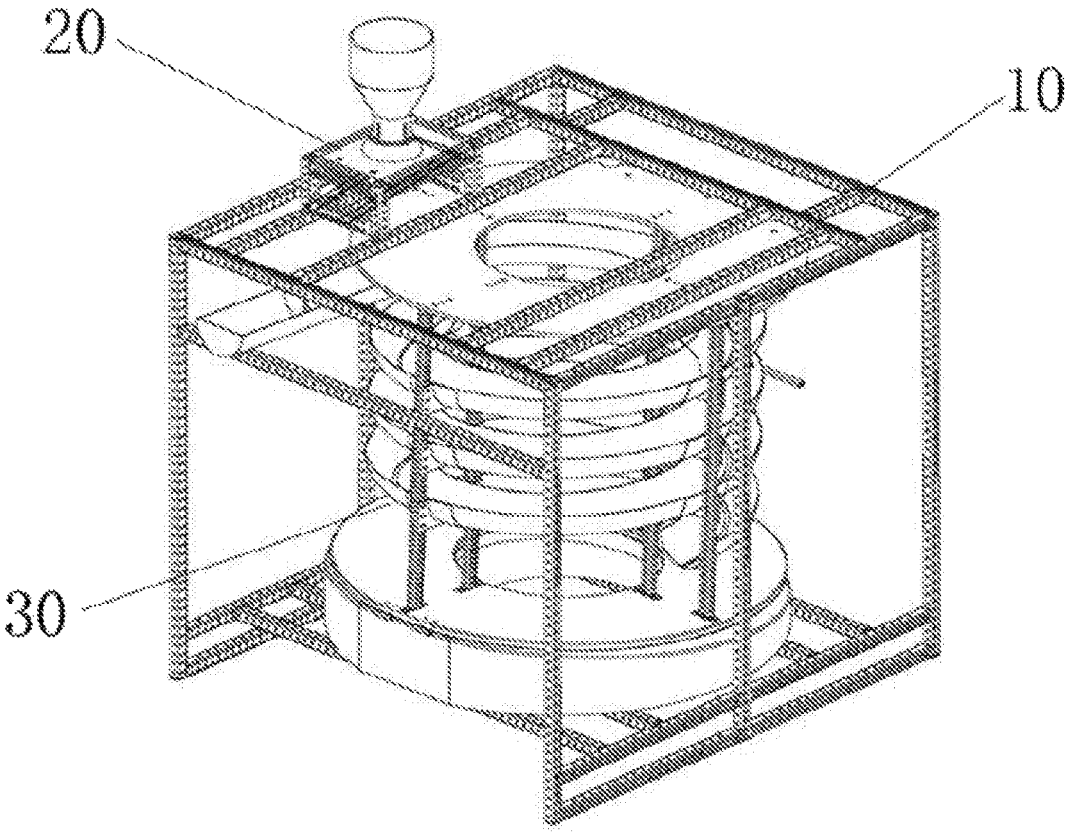
FIG. 1 is a schematic structure diagram of a bolt screening machine of the present disclosure.

As shown in FIG. 1, a bolt screening machine of the present disclosure, comprises an external frame 10, a feeding mechanism 20 and a screening mechanism 30, the external frame 10 is square in shape, the feeding mechanism 20 is combined with and mounted on a top of the external frame 0, the screening mechanism 30 is combined with and mounted inside the external frame 10. The external frame 10 is arranged corresponding to a feeding part of the screening mechanism 30, the feeding mechanism 20 is able to send unscreened bolts into the screening mechanism 30, and the screening mechanism 30 screens and arranges the unscreened bolts and then discharges the bolts. The screening mechanism 30 adopts spiral slideway structure, and the bolts slide from top to bottom in the screening mechanism 30 under the action of gravity. The screening mechanism 30 continuously vibrates during the screening process, which helps to speed up the screening process.

Figure 2:
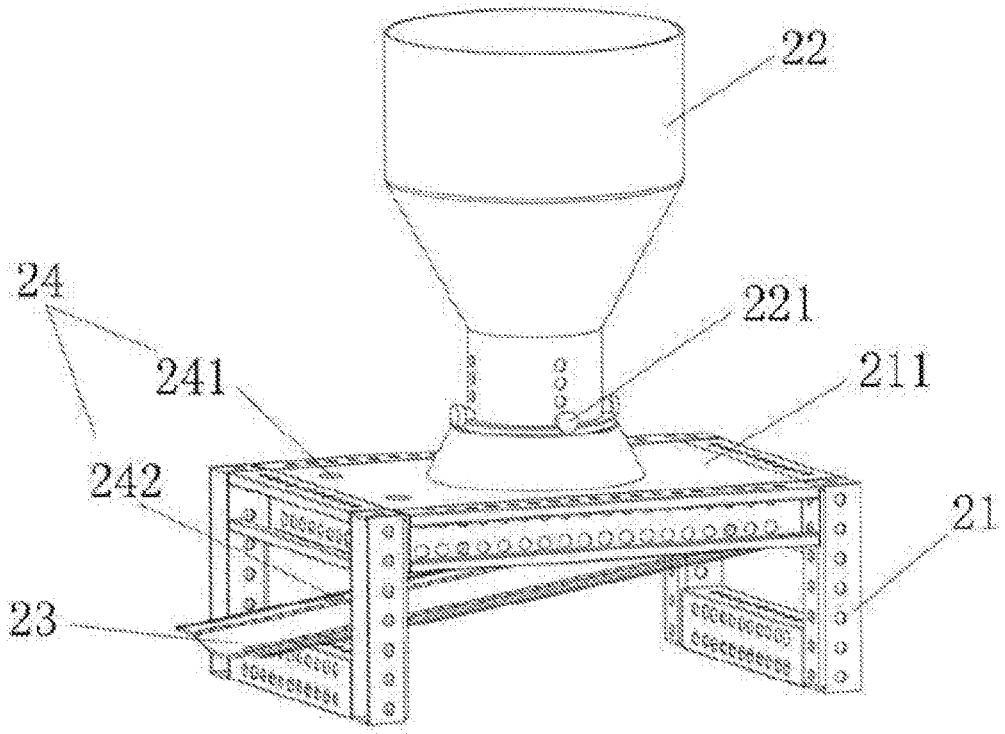
FIG. 2 is a schematic structure diagram of a feeding mechanism.

Specifically, as shown in FIG. 2, the feeding mechanism 20 comprises a feeding support 21, a feeding barrel 22, a feeding slideway 23 and a feeding electromagnet assembly 24, a top of the feeding support 21 has a feeding support plate 211, a bottom end of the feeding barrel 22 vertically penetrates the feeding support plate 211 to connect with the feeding support plate 211. The feeding barrel 22 stores the unscreened bolts. More further, a plurality of positioning pins 221 are provided at the bottom of the feeding barrel 22, and the positioning pins 221 are perpendicular to the side wall of the feeding barrel 22 and are detachably connected to the feeding barrel 22, and by mounting the positioning pins 221 at different positions on a side wall of the bottom of the feeding barrel 22, the up and down positions of the feeding barrel 22 can be changed. The feeding slideway 23 is arranged at a bottom of the feeding support plate 211, one end of the feeding slideway 23 is rotatably connected with the feeding support 21, and during the rotation process, the feeding slideway 23 blocks or opens the bottom end of the feeding barrel 22. The feeding electromagnet assembly 24 comprises a first feeding electromagnet 241 and a second feeding electromagnet 242, the first feeding electromagnet 241 is disposed at the bottom of the feeding support plate 211, the second feeding electromagnet 242 is arranged on the feeding slideway 23, and the first feeding electromagnet 241 is facing to the second feeding electromagnet 242. When the feeding electromagnet assembly 24 is powered on, the first feeding electromagnet 241 merges with the second feeding electromagnet 242, and the feeding slideway 23 is rotated by the second feeding electromagnet 242 to fit with the feeding support plate 211 and block the bottom end of the feeding barrel 22, and the bolts in the feeding barrel 22 cannot enter the screening mechanism 30; when the feeding electromagnet assembly 24 is powered off, the first feeding electromagnet 241 is separated from the second feeding electromagnet 242, the feeding slideway 23 rotates under the action of gravity, and no longer blocks the bottom end of the feeding barrel 22, the bolts in the feeding barrel 22 fall to the feeding slideway 23, and slide along the feeding slideway 23 to fall into the screening mechanism 30. By controlling the powering on or powering off of the feeding electromagnet assembly 24, the feeding mechanism assembly 20 can be controlled to start or stop conveying bolts, which is convenient to operate, and the feeding mechanism 20 has a simple and firm structure, which has a low failure rate and is convenient for maintenance.

Figure 3:
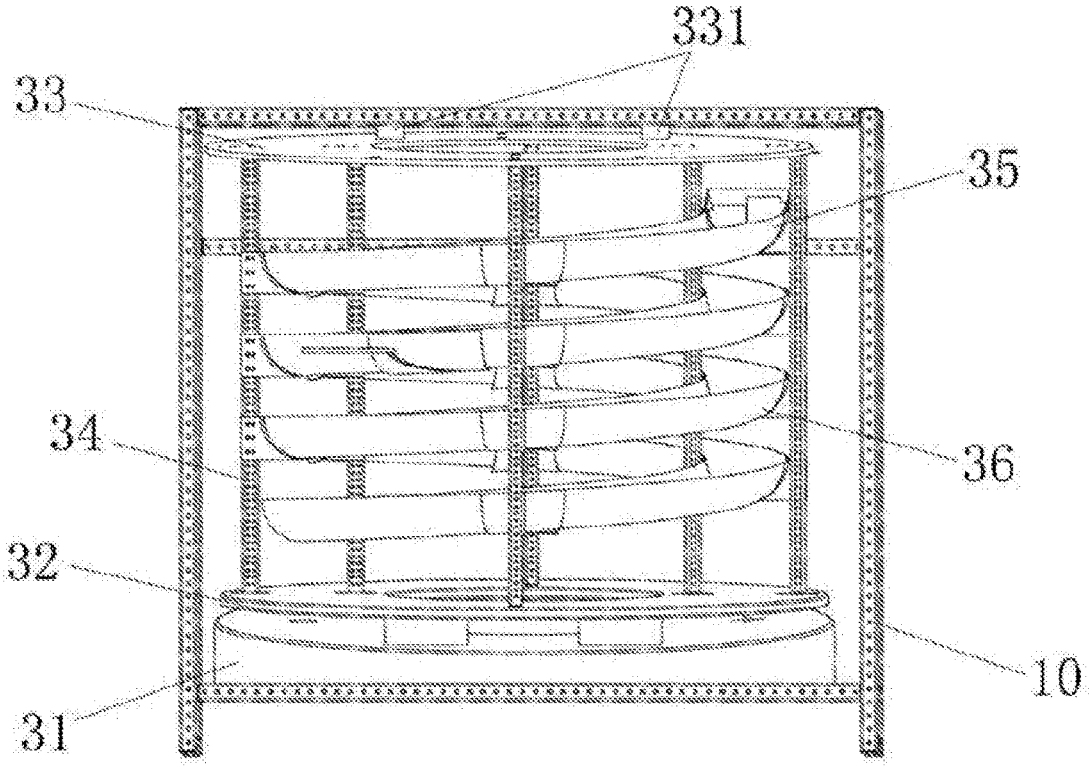
FIG. 3 is a rear view after the screening mechanism and the external frame are combined and mounted.

FIG. 3 is a rear view after the screening mechanism 30 and the external frame 10 are combined and mounted, the screening mechanism 30 is arranged inside the external frame 10, and the screening mechanism 30 comprises a base 31, a lower bottom plate 32, an upper top plate 33, a plurality of slideway support frames 34, a straight slideway 35, and a spiral slideway assembly 36, each slideway support frame 34 is connected between the lower bottom plate 32 and the upper top plate 33. The base 31 is fixedly connected to a bottom of the external frame 10, a top of the base 31 is a slope, the lower bottom plate 32 is rotatably connected to the top of the slope on the top of the base 31. The upper top plate 33 and the lower bottom plate 32 are arranged in parallel in alignment and the upper top plate 33 is disposed close to the top of the external frame 10; the plurality of slideway support frames 34 are parallel to each other and the plurality of slideway support frames 34 are all perpendicular to the lower bottom plate 32 and the upper top plate 33. When the lower bottom plate 32 rotates relative to the base 31, the lower bottom plate 32 drives the upper top plate 33 to rotate synchronously through the plurality of slideway support frames 34. Further, the upper top plate 33 comprises a vibrating electromagnet assembly 331, and the vibrating electromagnet assembly 331 is provided in combination with the upper top plate 33 and a top end of the external frame 10, by controlling the powering on or powering off of the vibrating electromagnet assembly 331, a relative distance between the upper top plate 33 and a top end of the external frame 10 can be controlled, and then the lower bottom plate 32 is rotated through the plurality of slideway support frames 34, that is, by controlling the powering on or powering off of the vibrating electromagnet assembly 331, the lower bottom plate 32, the upper top plate 33, and the plurality of slideway support frames 34 can be driven to move as a whole. By continuously powering on and off the vibrating electromagnet assembly 331, the lower bottom plate 32, the upper top plate 33, and the plurality of slideway support frames 34 can be controlled to generate vibration as a whole. The straight slideway 35 is connected with the spiral slideway assembly 36, the straight slideway 35 and the spiral slideway assembly 36 are fixedly connected to at least one of the slideway support frames 34 respectively, and the straight slideway 35 is arranged at a position near the upper top plate 33 and the straight slideway 35 extends beyond a horizontal coverage of the upper top plate 33, and the portion of the straight slideway 35 extending beyond the horizontal coverage of the upper top plate 33 is vertically aligned with the feeding slideway 23, and the unscreened bolts can fall into the straight slideway 35 through the feeding slideway 23. When the lower bottom plate 32, the upper top plate 33 and the plurality of slideway support frames 34 vibrate as a whole under the action of the vibrating electromagnet assembly 331, the straight slideway 35 and the spiral slideway assembly 36 will also generate vibrations therewith, which is beneficial to accelerate the sliding speed of the bolts in the straight slideway 35 and the spiral slideway assembly 36, and improve the screening efficiency.

Figure 4:
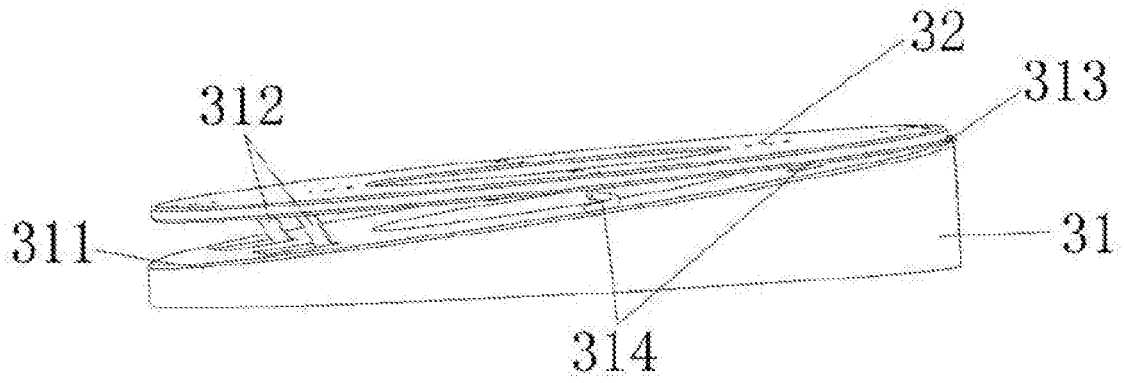
FIG. 4 is a schematic structure diagram after the base and the lower base plate are combined and mounted.

FIG. 4 is a schematic structure diagram after the base 31 and the lower base plate 33 are combined and mounted, the top of the base 31 has a slope 311, a bottom end of the slope 311 is provided with a leaf spring group 312, the top of the slope 311 has a hinge group 313, a top of the slope 311 is evenly provided with a plurality of springs 314, the lower bottom plate 32 is rotatably connected to the base 31 through the hinge group 313, and the lower bottom plate 32 is connected to the base 31 through the leaf spring group 312. The leaf spring group 312 and the springs 314 will accumulate elastic potential energy during the falling of the lower bottom plate 32, and will release during the rising of the lower bottom plate 32 to help the lower bottom plate 32 rise. The leaf spring group 312 and the springs 314 will also reduce the impact force during the falling of the lower base plate 32.

Figure 5:
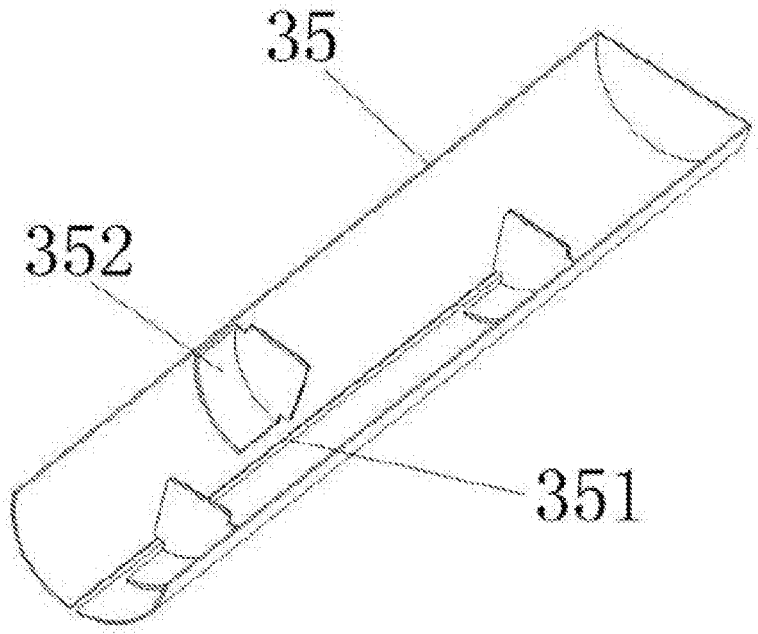
FIG. 5 is a schematic structure diagram of a straight slideway.

FIG. 5 is a schematic structure diagram of a straight slideway 35, the bottom of the straight slideway 35 has a straight sliding chute 351, and the straight sliding chute 351 is arranged along the axis of the straight slideway 35, the straight slideway 35 has a plurality of baffle plates 352 inside, and the baffle plates 352 are parallel to the cross-section of the straight slideway 35 and provided at intervals in the straight slideway 35. The bolts falling into the straight slideway 35 are blocked by the baffle plates 352 during the process of sliding through the straight slideway 35 and enter the spiral slideway assembly 36 in small batches each time to prevent the situation that a large number of bolts suddenly enter and cause screening errors. The scales of the straight sliding chute 351 is provided for the target bolts, and the target bolts will fall into the straight sliding chute 351 during the sliding process, and the straight sliding chute 351 will clamp the heads of the target bolts and transport them to the spiral slideway assembly 36.

Figure 6:
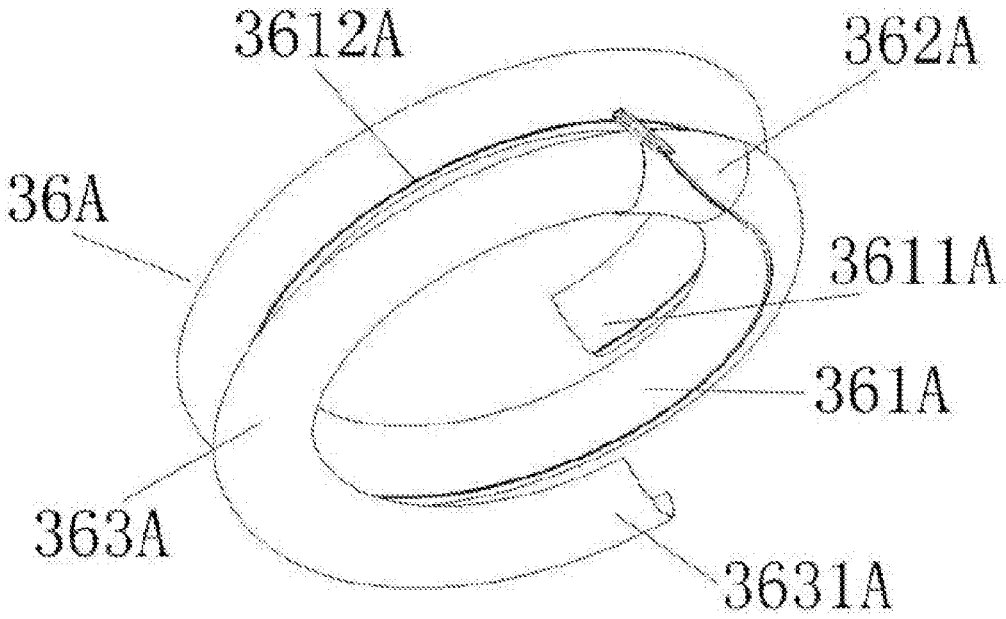
FIG. 6 is a schematic structure diagram of one section of spiral slideway in the spiral slideway assembly.

FIG. 6 is a schematic structure diagram of one section of spiral slideway 36A in the spiral slideway assembly 36, the spiral slide assembly 36 can provided with different types or numbers of spiral slideways according to the types or numbers of bolts to be screened, and the spiral slideways are arranged from up to down successively, and fixedly connected to the plurality of slideway support frames 34. The spiral slideway 36A comprises an upper slideway 361A, a discharge part 362A and a lower slideway 363A, the upper slideway 361A, the discharge part 362A and the lower slideway 363A are spirally arranged and connected from top to bottom, and the bolts that need to be screened out will be discharged through the upper slideway 361A to the discharge part 362A, and the bolts that do not need to be screened out will continue to slide down through the lower slideway 363A to another section of spiral slideway 36A or slide to the bottom.

The top end of the upper slideway 361A has an upper connecting end 3611A, and the upper slideway 361A is connected to the straight slideway 35 through the upper connecting end 3611A, and the bottom end of the lower slideway 363A has a lower connecting end 3631A. A bottom of the upper slideway 361A has an upper sliding chute 3612A, and the upper sliding chute 3612A is docked with the straight sliding chute 351 and has the same width as the straight sliding chute 351, and the bolts that need to be screened will slide into the upper sliding chute 3612A from the straight sliding chute 351; the upper sliding chute 3612A extends to the discharge part 362A along a spiral direction of the upper slideway 361, and the bolts to be screened will slide into the discharge part 362A along the upper sliding chute 3612A and then are discharged. During the sliding of the bolts in the upper sliding chute 3612A, the bolts that need to be screened without falling into the upper sliding chute 3612A will fall into the upper sliding chute 3612A under the action of vibration, and then be discharged through the discharge part 362A. According to the type and number of bolts to be screen, the spiral slideway assembly 36 can comprise multiple sections of spiral slideways, and the lower connecting end 3631A of the spiral slideway 36A can be connected to the upper connecting end of another section of spiral slideway, and the connected spiral slideways has upper sliding chutes with different widths, so as to screen different bolts. It is worth noting that the widths of the upper sliding chutes of the spiral slideways from top to bottom increase progressively.

Figure 7:
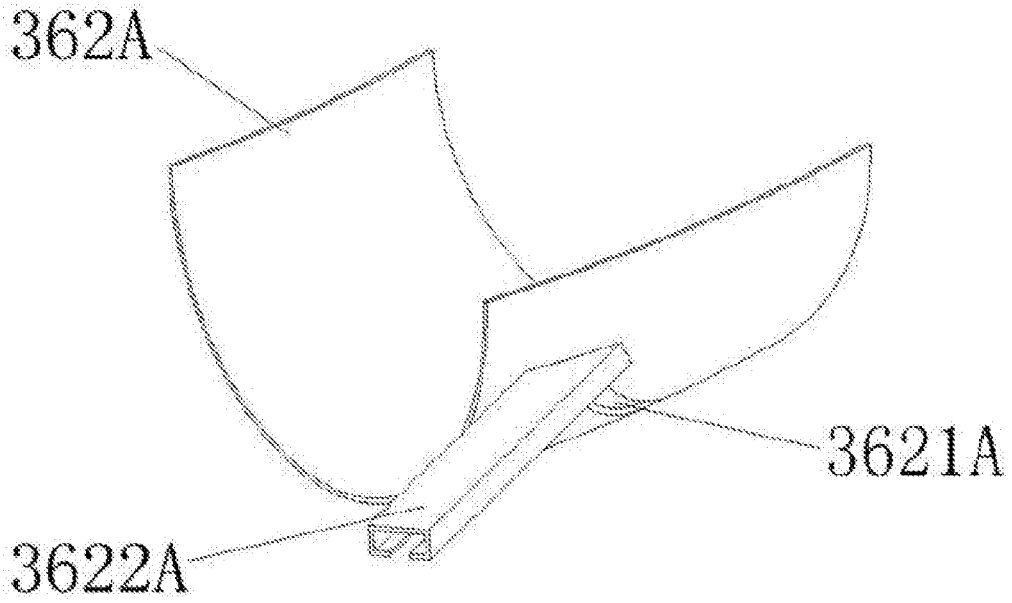
FIG. 7 is a schematic structure diagram of a discharge part of the spiral slideway.

FIG. 7 is a schematic structure diagram of the discharge portion 362A of the spiral slideway 36A, the discharge portion 362A has a discharge chute 3621A, one end of the discharge chute 3621A is docked with the upper sliding chute 3612A, the bolts falling into the upper sliding chute 3612A will slide into the discharge chute 3621A along the upper sliding chute 3612A. The other end of the discharge chute 3621A extends to a side wall of the discharge part 362A and penetrates the side wall of the discharge part 362A, the discharge part 362 has a discharge opening 3622A at a position where the discharge chute 3621A extends out of the side wall, the discharge opening 3622A extends linearly, and the discharge opening 3622A will clamp the heads of the target bolts. The bolt slides along the discharge chute 3621A and rushes into the discharge opening 3622A and then continues to move, and will rush out of the discharge opening 3622A under the action of inertia to complete the screening process.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

The invention claimed is:

1. A bolt screening machine comprising: an external frame, a feeding mechanism and a screening mechanism, the feeding mechanism is combined with and mounted on a top of the external frame, the screening mechanism is combined with and mounted inside the external frame, the screening mechanism comprises a base, a lower bottom plate, an upper top plate, a plurality of slideway support frames, a straight slideway, and a spiral slideway assembly, wherein each slideway support frame is connected between the lower bottom plate and the upper top plate, the base is fixedly connected to a bottom of the external frame, a top of the base is a slope, the lower bottom plate is rotatably connected to the slope on the top of the base, the upper top plate and the lower bottom plate are arranged in parallel in alignment and the upper top plate is disposed close to the top of the external frame, the straight slideway and the spiral slideway assembly are fixedly connected to at least one of the slideway support frames respectively, and the straight slideway is arranged at a position near the upper top plate and the straight slideway extends beyond a horizontal coverage of the upper top plate, and a portion of the straight slideway extending beyond the horizontal coverage of the upper top plate is vertically aligned with the feeding slideway, the spiral slideway assembly comprises at least one section of spiral slideway, the spiral slideway has a sliding chute and a discharge part provided for bolts to be screened, and after the bolts enter the screening mechanism through the feeding mechanism, the bolts spirally slide down in the screening mechanism and are screened through the sliding chute and then discharged through the discharge part.

2. The bolt screening machine according to claim 1, wherein the feeding mechanism comprises a feeding support, a feeding barrel and a feeding slideway, a top of the feeding support has a feeding support plate, a bottom end of the feeding barrel vertically penetrates the feeding support plate to connect with the feeding support plate, the feeding slideway is arranged at a bottom of the feeding support plate, and one end of the feeding slideway is rotatably connected with the feeding support.

3. The bolt screening machine according to claim 2, wherein the feeding mechanism comprises a feeding electromagnet assembly, the feeding electromagnet assembly comprises a first feeding electromagnet and a second feeding electromagnet, the first feeding electromagnet is disposed at the bottom of the feeding support plate, the second feeding electromagnet is arranged on the feeding slideway, and the first feeding electromagnet is facing to the second feeding electromagnet.

4. The bolt screening machine according to claim 1, wherein the spiral slideway comprises an upper slideway, the discharge part and a lower slideway, the upper slideway, the discharge part and the lower slideway are spirally arranged and connected from top to bottom, and a bottom of the upper slideway has an upper sliding chute, and the upper sliding chute extends to the discharge part along a spiral direction of the upper slideway.

5. The bolt screening machine according to claim 4, wherein the discharge part has a discharge chute, one end of the discharge chute is docked with the upper sliding chute, and the bolts falling into the upper sliding chute will slide into the discharge chute along the upper sliding chute, the other end of the discharge chute extends to a side wall of the discharge part and penetrates the side wall of the discharge part, the discharge part has a discharge opening at a position where the discharge chute extends out of the side wall, and the discharge opening extends linearly.

6. The bolt screening machine according to claim 1, wherein the upper top plate comprises a vibrating electromagnet assembly, and the vibrating electromagnet assembly is provided in combination with the upper top plate and a top end of the external frame.

7. The bolt screening machine according to claim 1, wherein the top of the base has a slope, the top of the slope has a hinge group, and the lower bottom plate is rotatably connected to the base through the hinge group.

8. The bolt screening machine according to claim 7, wherein a bottom end of the slope is provided with a leaf spring group, and the lower bottom plate is connected to the base through the leaf spring group.

9. The bolt screening machine according to claim 7, wherein a top of the slope is evenly provided with a plurality of springs.

* * * * *